US008398506B2

(12) United States Patent
Stites

(10) Patent No.: US 8,398,506 B2
(45) Date of Patent: Mar. 19, 2013

(54) GOLF CLUBS AND GOLF CLUB HEADS

(75) Inventor: John T. Stites, Weatherford, TX (US)

(73) Assignee: Nike, Inc., Beaverton, OR (US)

( * ) Notice: Subject to any disclaimer, the term of this patent is extended or adjusted under 35 U.S.C. 154(b) by 289 days.

(21) Appl. No.: 12/730,684

(22) Filed: Mar. 24, 2010

(65) Prior Publication Data

US 2010/0203983 A1 Aug. 12, 2010

Related U.S. Application Data

(63) Continuation-in-part of application No. 12/141,580, filed on Jun. 18, 2008, now Pat. No. 8,133,135.

(60) Provisional application No. 61/007,929, filed on Jun. 21, 2007.

(51) Int. Cl.
*A63B 53/04* (2006.01)

(52) U.S. Cl. ..... 473/345; 473/350

(58) Field of Classification Search ..... 473/324–350, 473/287–292

See application file for complete search history.

(56) References Cited

U.S. PATENT DOCUMENTS

| | | | | |
|---|---|---|---|---|
| 4,021,047 | A * | 5/1977 | Mader | 473/345 |
| 4,630,827 | A * | 12/1986 | Yoneyama | 473/348 |
| 4,874,171 | A * | 10/1989 | Ezaki et al. | 473/290 |
| 5,451,056 | A | 9/1995 | Manning | |
| 5,518,240 | A * | 5/1996 | Igarashi | 473/345 |
| 5,665,014 | A * | 9/1997 | Sanford et al. | 473/345 |
| 5,788,584 | A | 8/1998 | Parente et al. | |
| 5,833,551 | A * | 11/1998 | Vincent et al. | 473/350 |
| 5,938,540 | A * | 8/1999 | Lu | 473/288 |
| 6,149,534 | A | 11/2000 | Peters et al. | |
| 6,368,234 | B1 | 4/2002 | Galloway | |
| 6,471,603 | B1 | 10/2002 | Kosmatka | |
| 6,471,604 | B2 * | 10/2002 | Hocknell et al. | 473/334 |
| 6,569,029 | B1 | 5/2003 | Hamburger | |
| 6,575,845 | B2 * | 6/2003 | Galloway et al. | 473/329 |
| 6,623,378 | B2 * | 9/2003 | Beach et al. | 473/345 |
| 6,739,983 | B2 | 5/2004 | Helmstetter et al. | |
| 6,929,563 | B2 * | 8/2005 | Nishitani | 473/334 |
| 7,025,692 | B2 | 4/2006 | Erickson et al. | |
| 7,128,662 | B2 * | 10/2006 | Kumamoto | 473/345 |

(Continued)

FOREIGN PATENT DOCUMENTS

| | | |
|---|---|---|
| JP | 07284546 | 10/1995 |
| JP | 2007-054198 | 3/2007 |

(Continued)

OTHER PUBLICATIONS

Office Action issued in related Chinese Application No. 200880021522.2, dated Apr. 25, 2011(English translation only).

(Continued)

*Primary Examiner* — Sebastiano Passaniti
(74) *Attorney, Agent, or Firm* — Banner & Witcoff, Ltd.

(57) ABSTRACT

Golf club heads including first section and a second section that are separate and distinct from one another and are engaged to form at least a portion of the golf club head. The first section may include a first ledge member and the second section may include a second ledge member and the first ledge member may be engaged with the second ledge member to form a junction area. The first ledge member may include a first vertical side and a second vertical side and a horizontal side therebetween and the second ledge member may include a first vertical side and a second vertical side and a horizontal side therebetween. The first and second ledge members may be complementary. Golf clubs including these club heads and methods of making a golf club and golf club heads also are provided.

20 Claims, 6 Drawing Sheets

U.S. PATENT DOCUMENTS

| | | | | |
|---|---|---|---|---|
| 7,128,664 | B2 * | 10/2006 | Onoda et al. | 473/347 |
| 7,163,468 | B2 | 1/2007 | Gibbs et al. | |
| 7,175,541 | B2 | 2/2007 | Lo | |
| 7,601,078 | B2 * | 10/2009 | Mergy et al. | 473/345 |
| 7,658,686 | B2 * | 2/2010 | Soracco | 473/342 |
| 7,682,264 | B2 * | 3/2010 | Hsu et al. | 473/342 |
| 2004/0009829 | A1 | 1/2004 | Kapilow | |
| 2005/0020379 | A1 * | 1/2005 | Kumamoto | 473/332 |
| 2005/0026723 | A1 * | 2/2005 | Kumamoto | 473/345 |
| 2005/0119068 | A1 | 6/2005 | Onoda et al. | |
| 2005/0215350 | A1 | 9/2005 | Reyes et al. | |
| 2005/0221914 | A1 * | 10/2005 | Ezaki et al. | 473/345 |
| 2005/0221915 | A1 * | 10/2005 | De Shiell et al. | 473/345 |
| 2005/0233831 | A1 * | 10/2005 | Ezaki et al. | 473/342 |
| 2006/0000528 | A1 | 1/2006 | Galloway | |
| 2006/0079349 | A1 | 4/2006 | Rae et al. | |
| 2006/0148588 | A1 | 7/2006 | Gibbs et al. | |
| 2006/0252576 | A1 * | 11/2006 | Lo | 473/342 |
| 2006/0281582 | A1 | 12/2006 | Sugimoto | |
| 2007/0049407 | A1 | 3/2007 | Tateno et al. | |
| 2008/0009364 | A1 * | 1/2008 | Chen | 473/324 |
| 2008/0039228 | A1 | 2/2008 | Breier et al. | |
| 2008/0102985 | A1 * | 5/2008 | Chen | 473/345 |
| 2008/0139339 | A1 | 6/2008 | Cheng | |
| 2009/0048035 | A1 | 2/2009 | Stites et al. | |
| 2009/0075751 | A1 | 3/2009 | Gilbert et al. | |
| 2009/0098949 | A1 | 4/2009 | Chen | |
| 2010/0041490 | A1 * | 2/2010 | Boyd et al. | 473/288 |
| 2010/0056298 | A1 | 3/2010 | Jertson et al. | |
| 2011/0118051 | A1 | 5/2011 | Thomas | |

FOREIGN PATENT DOCUMENTS

| | | |
|---|---|---|
| WO | 2006073930 | 7/2006 |
| WO | 2008/157691 | 12/2008 |

OTHER PUBLICATIONS

Office Action issued in parent U.S. Appl. No. 12/141,580 mailed Jul. 7, 2011.
Office Action issued in related U.S. Appl. No. 12/700,471, mailed Sep. 8, 2011.
Office Action Issued in parent U.S. Appl. No. 12/141,580 mailed Dec. 20, 2010.
Feb. 29, 2012 Office Action issued in related Japanese Application No. 2010-513407.
Partial International Search Report in related PCT/US2008/067499, mailed Jan. 22, 2009.
International Preliminary Report on Patentability and Written Opinion in related PCT/US2008/067499 mailed Jan. 7, 2010.
International Search Report and Written Opinion issued May 6, 2011 in corresponding PCT/US2011/023968.
Office Action issued in corresponding U.S. Appl. No. 12/141,580, mailed May 27, 2010.
Notice of Allowance issued in related U.S. Appl. No. 12/700,471, mailed Mar. 15, 2012.
Office Action from EP Application No. 08771477.0 mailed Sep. 25, 2012.
Office Action from CN Application No. 200880021522.2 mailed Apr. 13, 2012.
Office Action from U.S. Appl. No. 13/550,194, mailed Oct. 31, 2012.

* cited by examiner

GOLF CLUBS AND GOLF CLUB HEADS

RELATED APPLICATION DATA

This application is a continuation-in part of U.S. patent application Ser. No. 12/141,580 filed, Jun. 18, 2008 which claims priority to U.S. Provisional Patent Application No. 61/007,929, filed Jun. 21, 2007. These prior applications are entirely incorporated herein by reference.

FIELD OF THE INVENTION

The present disclosure relates to golf clubs and golf club heads. Particular example aspects of this disclosure relate to the design, structure, and manufacturing of golf club heads.

BACKGROUND

In recent years, golfers have witnessed dramatic changes and improvements in golf equipment. During this time, golf clubs and particularly, golf club heads, have been the subject of much technological research by golf club manufacturers. While this research has greatly improved golf club heads, there is room in the art for further advances in golf club head technology. For example, the design, structure, and manufacturing of golf club heads may still be improved.

SUMMARY

The following presents a general summary of aspects of the disclosure in order to provide a basic understanding and various aspects of the disclosure. This summary is not intended to limit the scope of the disclosure in any way, but it simply provides a general overview and context for the more detailed description that follows.

Aspects of this invention relate to golf club heads comprising a wood type golf club head body including a ball striking face portion, a top and a sole. Further, at least one of the ball striking face portion, the top and the sole of the golf club head body constitutes a first portion that includes a first section and a second section that are separate and distinct from one another and may be engaged to form at least a part of the first portion. Further, the first section may include a first ledge member, the second section may include a second ledge member and the first ledge member may be configured to engage the second ledge member to form a junction area. Additionally, the first ledge member may include a first vertical side and a second vertical side and a horizontal side therebetween and the second ledge member may include a first vertical side and a second vertical side and a horizontal side therebetween. Further, the first and second ledge members are complementary wherein when the first and second ledge members are engaged the first vertical side of the first ledge member may match and engage with the first vertical side of second ledge member, the second vertical side of the first ledge member may match and engage with the second vertical side of the second ledge member, and the horizontal side of the first ledge member may match and engage with the horizontal side of the second ledge member.

Further aspects of this invention relate to golf club heads comprising an iron type golf club head body including an iron type golf club head body including a ball striking face portion and a rear portion. The ball striking face portion and the rear portion may separate and distinct from one another and may engaged to form at least a part of the iron type golf club head body. Further, the ball striking face portion may include a first ledge member, the rear portion may include a second ledge member and the first ledge member may engage the second ledge member to form a junction area. Additionally, the first ledge member may include a first vertical side and a second vertical side and a horizontal side therebetween and the second ledge member may include a first vertical side and a second vertical side and a horizontal side therebetween. Further, the first and second ledge members may be complementary so that when the first and second ledge members are engaged the first vertical side of the first ledge member may match and engage with the first vertical side of second ledge member, the second vertical side of the first ledge member may match and engage with the second vertical side of the second ledge member, and the horizontal side of the first ledge member may match and engage with the horizontal side of the second ledge member.

Additional aspects of this disclosure relate to wood-type or iron-type golf club structures that include golf club heads, e.g., of the types described above. Such golf club structures further may include one or more of: a shaft member attached to the club head (optionally via a separate hosel member or a hosel member provided as an integral part of one or more of the club head or shaft); a grip or handle member attached to the shaft member; etc.

Still additional aspects of this disclosure relate to methods for producing golf club heads and golf club structures, e.g., of the types described above. Such methods may include, for example: (a) providing a golf club head of the various types described above, e.g., by manufacturing or otherwise constructing the golf club head body, by obtaining the golf club head body from another source, etc.; and (b) engaging a shaft member with the golf club head body at a separate hosel member or a hosel member provided as an integral part of one or more of the club head or shaft. Methods according to examples of this disclosure may include additional steps, such as engaging a grip member with the shaft member; club head body finishing steps, etc.

BRIEF DESCRIPTION OF THE DRAWINGS

The present invention is illustrated by way of example and not limited in the accompanying figures, in which like reference numerals indicate similar elements throughout, and in which.

Figure 1:
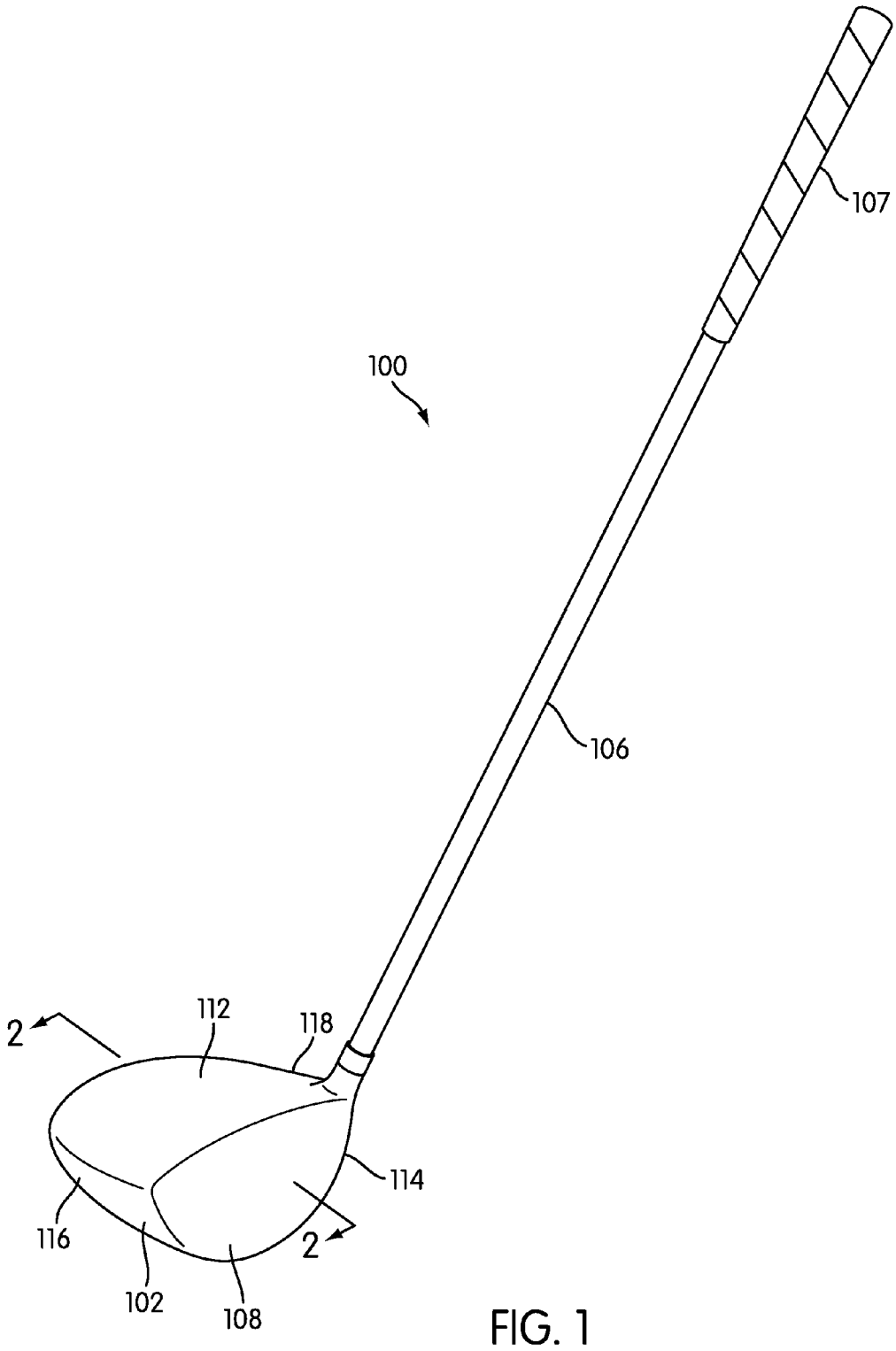
FIG. 1 is an illustrative embodiment of a golf club with a wood type golf club head according to at least some aspects of this disclosure.

The reader is advised that the various parts shown in these drawings are not necessarily drawn to scale.

DETAILED DESCRIPTION

The following description and the accompanying figures disclose features of golf club heads and golf clubs in accordance with examples of the present disclosure.

I. General Description of Example Golf Club Heads, Golf Clubs, and Methods in Accordance with this Invention Aspects of this disclosure relate to wood-type golf club heads. Wood-type golf club heads according to at least some example aspects of this disclosure may include: (a) a wood-type golf club head body; (b) a ball striking face portion (including a ball striking face plate integrally formed with the ball striking face portion or attached to a frame member such that the face plate and frame portion together constitute the overall ball striking face portion); (c) a toe end; (d) a heel end; (e) a top, or crown; and (f) a bottom, or sole. The club head body itself also may be constructed from any suitable or desired materials without departing from this disclosure, including from conventional materials known and used in the art. For example, wide varieties of overall club head constructions are possible without departing from this disclosure. For example, if desired, some or all of the various individual parts of the club head body may be made from multiple pieces that are connected together (e.g., by adhesives or cements; by welding, soldering, brazing, or other fusing techniques; by mechanical connectors; etc.). The various parts (e.g., crown, sole, a ball striking face portion (e.g., a cup face), etc.) may be made from any desired materials and combinations of different materials, including materials that are conventionally known and used in the art, such as metal materials, including lightweight metal materials (e.g., titanium, titanium alloys, aluminum, aluminum alloys, magnesium, magnesium alloys, etc.,) composite materials, polymer materials, etc. The club head body and/or its various parts may be made by forging, casting, molding, and/or using other techniques and processes, including techniques and processes that are conventional and known in the art.

Further aspects of this disclosure relate to iron-type golf club heads. Iron-type golf club heads according to at least some example aspects of this disclosure may include: (a) an iron type golf club head body; (b) a ball striking face portion (including a ball striking face plate integrally formed with the face member or attached to a frame member such that the face plate and frame member together constitute the overall face member); and (c) a rear portion. The club head body itself also may be constructed from any suitable or desired materials without departing from this disclosure, including from conventional materials known and used in the art. For example, a wide variety of overall club head constructions are possible without departing from this invention. For example, if desired, some or all of the various individual parts of the club head body described above may be made from multiple pieces that are connected together (e.g., by adhesives or cements; by welding, soldering, brazing, or other fusing techniques; by mechanical connectors; etc.). The various parts (e.g., ball striking face portion and the sole portion, etc.) may be made from any desired materials and combinations of different materials, including materials that are conventionally known and used in the art, such as metal materials, including lightweight metal materials, composite materials, polymer materials, etc. The club head body and/or its various parts may be made by forging, casting, molding, and/or using other techniques and processes, including techniques and processes that are conventional and known in the art.

Further aspects of this disclosure relate to golf club structures wherein the overall wood-type or iron-type golf club structure may include a hosel region, a shaft member received in and/or inserted into and/or through the hosel region, and a grip or handle member attached to the shaft member. Optionally, if desired, the external hosel region may be eliminated and the shaft member may be directly inserted into and/or otherwise attached to the head member (e.g., through an opening provided in the top of the club head, through an internal hosel member (e.g., provided within an interior chamber defined by the club head), etc.). The hosel member may be integrally formed as part of the club head structure, or it may be separately formed and engaged therewith (e.g., by adhesives or cements; by welding, brazing, soldering, or other fusing techniques; by mechanical connectors; etc.). Conventional hosels and their inclusion in a wood-type or iron-type club head structure may be used without departing from this disclosure.

The shaft member may be received in, engaged with, and/or attached to the club head in any suitable or desired manner, including in conventional manners known and used in the art, without departing from the disclosure. As more specific examples, the shaft member may be engaged with the club head via a hosel member and/or directly to the club head structure, e.g., via adhesives, cements, welding, soldering, mechanical connectors (such as threads, retaining elements, or the like), etc.; through a shaft-receiving sleeve or element extending into the club head body; etc. If desired, the shaft may be connected to the head in a releasable manner using mechanical connectors to allow easy interchange of one shaft for another.

The shaft member also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member may be attached to, engaged with, and/or extend from the shaft member in any suitable or desired manner, including in conventional manners known and used in the art, e.g., using adhesives or cements; via welding, soldering, brazing, or the like; via mechanical connectors (such as threads, retaining elements, etc.); etc. As another example, if desired, the grip or handle member may be integrally formed as a unitary, one-piece construction with the shaft member. Additionally, any desired grip or handle member materials may be used without departing from this disclosure, including, for example: rubber materials, leather materials, rubber or other materials including cord or other fabric material embedded therein, polymeric materials, cork materials, and the like.

Still other additional aspects of this disclosure relate to methods for producing wood-type or iron-type golf club heads and wood-type or iron-type golf club structures in accordance with examples of this disclosure. Such methods may include, for example, one or more of the following steps in any desired order and/or combinations: (a) providing a wood-type or iron-type golf club head body and/or a golf club head of the various types described above (including any or all of the various structures, features, and/or arrangements described above), e.g., by manufacturing or otherwise constructing the golf club head body or the golf club head, by obtaining it from a third party source, etc.; (b) engaging a shaft member with the golf club head; (c) engaging a grip member with the shaft member; etc.

Given the general description of various example aspects of the disclosure provided above, more detailed descriptions of various specific examples of golf clubs and golf club head structures according to the disclosure are provided below.

II. Detailed Description of Example Golf Club Heads, Golf Club Structures, and Methods According to the Invention The following discussion and accompanying figures describe various example golf clubs and golf club head structures in accordance with the present disclosure. When the same reference number appears in more than one drawing, that reference number is used consistently in this specification and the drawings to refer to the same or similar parts throughout.

An illustrative embodiment according to one or more aspects of the disclosure is shown in FIG. 1. FIG. 1 shows a golf club 100 at the address position which includes a wood-type golf club head 102 in accordance with aspects of this disclosure and a shaft 106 and grip 107 engaged with the wood-type golf club head 102. According to some aspects of the disclosure, the dimensions of the club head body 102 may include a volume between 100-500 cubic centimeters (e.g., 460 cubic centimeters) and a mass between 75 and 250 grams (e.g., 150 grams). Further, according to aspects of this disclosure, the interior of the golf club head body 102 may be substantially hollow. As seen in FIG. 1, the wood-type golf club head body 102 includes a ball striking face portion 108, a crown (or top) 112, a sole (or bottom) 114, a toe end 116 and a heel end 118. The ball striking face portion may include the ball striking face and a portion of the golf club head body that extends rearwardly from the ball striking face (e.g., around the perimeter of the ball striking face) towards the rear of the golf club head body. For example, the ball striking face portion 108 may be a cup face engaged with remainder of the golf club head body 102. The top (or crown) 112 may extend along the uppermost region of the golf club head body 102 and further may include the upper half of the golf club head body. The bottom (or sole) 114 may extend along the lowermost region of the golf club head body 102 and further may include the lower half of the golf club head body. The golf club head body 102 may have any desired shape, such as a traditionally curved shape (as shown in FIG. 1) or generally rectangular or square shape.

As discussed above, the golf club head body 102 may be formed of different portions including: ball striking face portion 108, the crown or top 112, a sole or bottom 114. The wall thickness of each of the above described portions of the golf club head body may be between 0.25-10 mm, 0.5-8 mm, 1-5 mm or 1.5-2 mm. Further, the above described portions of the golf club head body may, themselves, be comprised of various sections which are joined together by various methods, such as through the use of cements or adhesives; mechanical connectors, (e.g., releasable mechanical connections); and/or welding, soldering, brazing, or other fusing techniques. According to aspects of the disclosure, the various sections may be configured to engage with each other. For example, the various sections may include sides that are configured to engage with sides of the other sections. For example, according to aspects of the disclosure, the sections may include matching sides. In other words, the sides of the sections may match with corresponding sides of the other sections so that the sections mate with each other.

Figure 2:
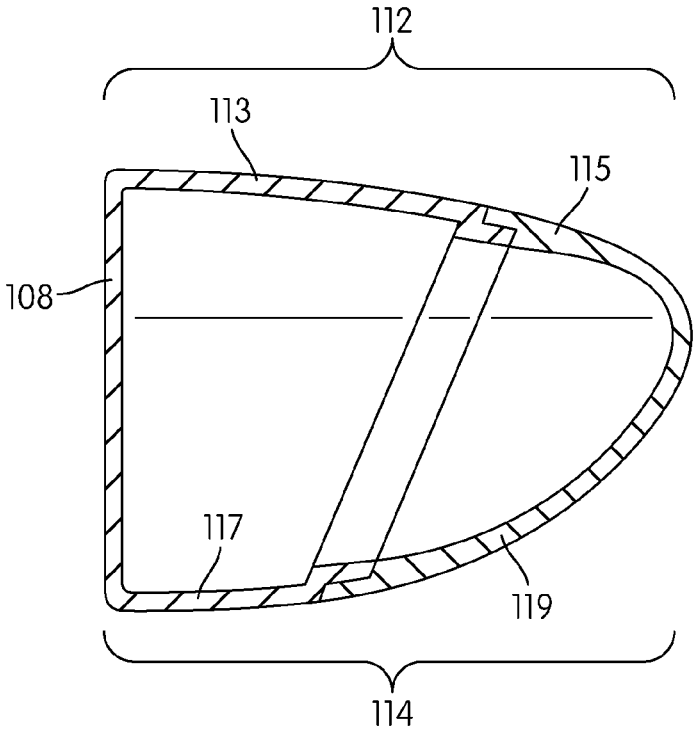
FIG. 2 is a cross sectional view of the wood type golf club head structure shown in FIG. 1.
Figure 3:
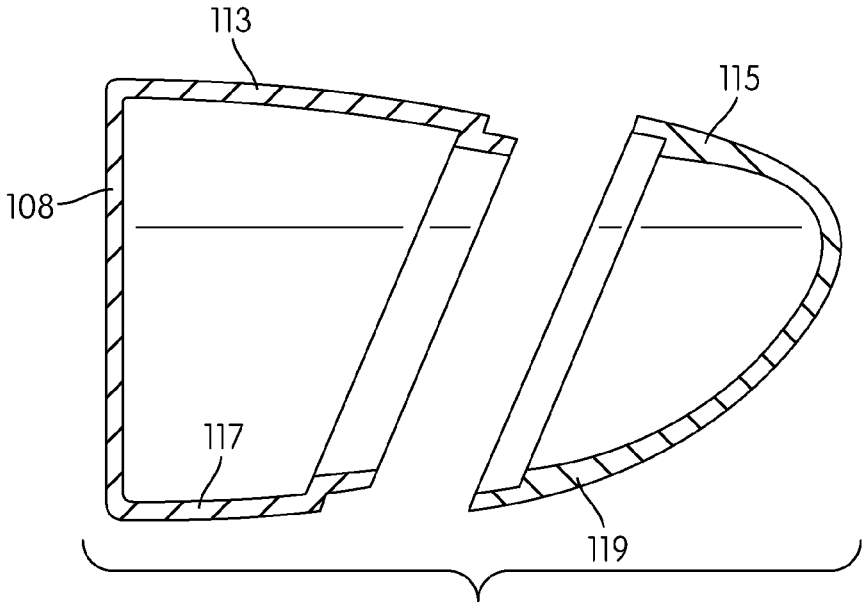
FIG. 3 is an exploded view of the cross-sectional view shown in FIG. 2.

FIG. 2 shows a cross-sectional view of the wood-type golf club head 102. As seen in FIG. 2, the crown 112 includes two separate and distinct sections: a first section 113 and a second section 115 that are joined together to form the crown 112. Similarly, the sole 114 includes two separate and distinct sections: a first section 117 and a second section 119 that are joined together to form the sole 114. FIG. 3 shows an exploded view of the above golf club head body 102 wherein the first and second sections of the crown 112 and the sole 114 are separated from each other.

Figure 4:
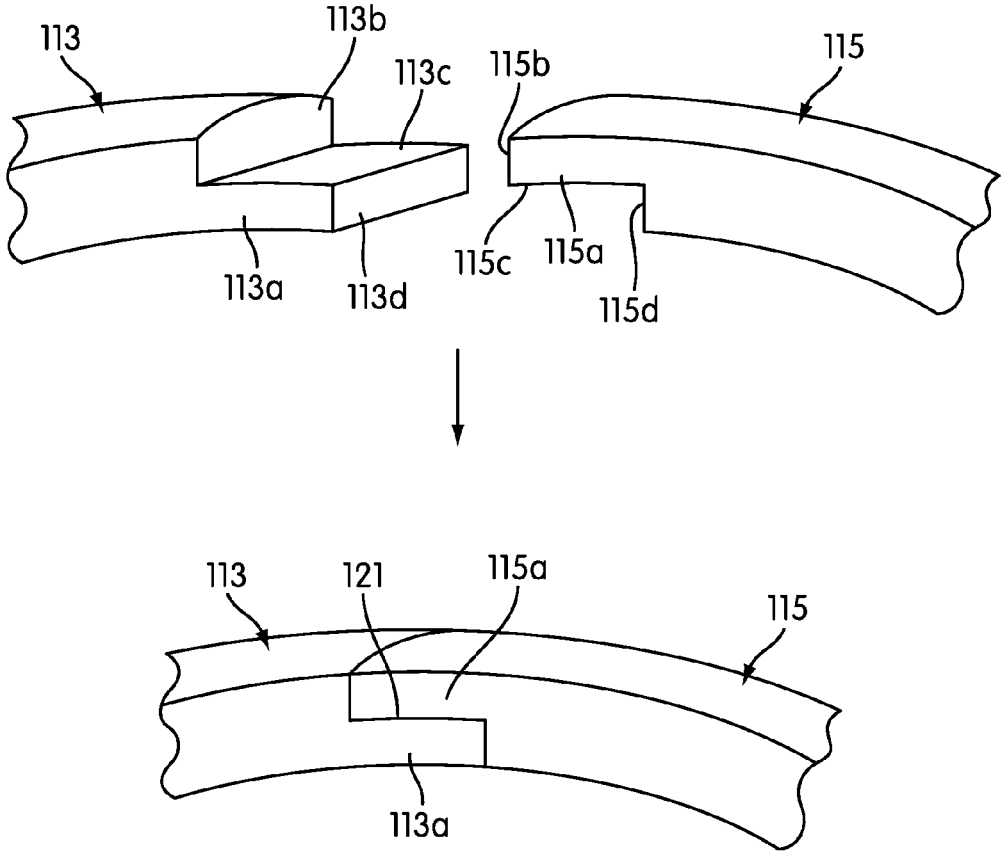
FIG. 4 is a view of a junction between different sections of a golf club head according to at least some aspects of this disclosure.

FIG. 4 is an enlarged view of the first section 113 and second section 115 of the crown 112 which is used to illustrate the engagement procedure wherein the first section 113 and second section 115 are joined together at a junction or joint 121 to form the crown 112 according to one aspect of this disclosure. According to aspects of the disclosure, the first section 113 may include sides that are configured to engage with sides of second section 115. Further, according to aspects of the disclosure, the first section 113 and the second section 115 may include mating sides. In other words, the sides of the first section 113 may match with corresponding sides of the second section 115 so the first section 113 mates with the second section 115. In this disclosure, a "match" means a counterpart. In other words, a "match" is a thing that closely resembles another or is one of two parts that fit, complete, or complements one another. The words "matches" or "matching" have respective meanings For example, a side that "matches" another side or, in other words, "matching" sides, may have virtually the same size, dimensions, etc.

For example, as illustrated in FIG. 4, the first section 113 may include a ledge member 113*a* configured to engage a mating ledge member 115*a* of second section 115. As seen in FIG. 4, ledge member 113*a* may be configured to include two vertical sides 113*b*, 113*d* and a horizontal side 113*c* therebetween. Further, mating ledge member 115*a* may also be configured to include two vertical sides 115*b*, 115*d* and a horizontal side 115*c* therebetween. As seen, the ledge member 113*a* may have a configuration wherein when the club head body 102 is at the address position, a first vertical side 113*b* is at a greater height than the second vertical side 113*d*. Further, the horizontal side 113*c* of the ledge member 113*a* may extend horizontally between the lower edge of the first vertical side 113*b* and the upper edge of the second vertical side 113*d*. Additionally, in such an embodiment, when the club head body 102 is at the address position, the surface of the horizontal side 113*c* may face upward. Hence, in such an embodiment, when the club head body 102 is at the address position, the three sides 113*b*, 113*c* and 113*d* of ledge member 113*a* are configured in a "stair step" arrangement. The sides of the ledge member 115*a* may be configured in a similar arrangement that mates with the sides of the first ledge member 113*a*. For example, as seen the sides of the second ledge member 115 may be configured wherein when the club head body 102 is at the address position, a first vertical side 115*b* is at a greater height than the second vertical side 115*d*. Further, the horizontal side 115*c* of the ledge member 115*a* may extend horizontally between the lower edge of the first vertical side 115*b* and the upper edge of the second vertical side 115*d*. Additionally, in such an embodiment, when the club head body 102 is at the address position, the surface of the horizontal side 115*c* may face downward. Hence, in such an embodiment, when the club head body 102 is at the address position, the three sides 115*b*, 115*c* and 115*d* of ledge member 115*a* are configured in an "inverted stair step" arrangement.

Therefore, the arrangement of the sides (113*b*, 113*c*, 113*d*) of ledge member 113*a* (i.e., the "stair step" configuration) and the arrangement of the sides (115*b*, 115*c*, 115*d*) of ledge member 115*a* (i.e., the "inverted stair step" configuration) are complementary. In other words, the each of the sides (113*b*, 113*c*, 113*d*) of the first section 113 may match with corresponding sides (115*b*, 115*c*, 115*d*, respectively) of the second section 115 so the first section 113 mates with the second section 115.

Therefore, when the ledges 113*a* and 115*a* are engaged, the first vertical side 113*b* of ledge member 113*a* and matches and engages with the first vertical side 115*b* of ledge member 115*a*, the second vertical side 113*d* of ledge member 113*a* matches and engages with the second vertical side 115*d* of ledge member 115*a*, and the horizontal side 113*c* of ledge member 113*a* matches and engages with the horizontal side 115*c* of ledge member 115*a*. For example, as shown in FIG. 4, the sides of the first ledge member 113*a* may abut their respective matching sides of the second ledge member 115*a*. In this way, the sections 113 and 115 are mated with each other.

According to aspects of this disclosure, the matching sides of the ledge members may have substantially the same shape and dimensions. In this disclosure the word substantially means within a range of 5%. For example, in the depicted embodiment, the shape and dimensions of the first vertical side 113*b* of ledge member 113*a* may be substantially the same as the shape and dimensions of the matching first vertical side 115*b* of ledge member 115*a*. Similarly, the second vertical side 113*d* may have substantially the same shape and dimensions as the matching second vertical side 115*d* and the horizontal side 113*c* may have substantially the same shape and dimensions as the matching horizontal side 115*c*.

According to aspects of this disclosure, the sides of the ledges 113 and 115 may be planar. For example, as shown in the depicted embodiment, each of three of sides of the ledge member 113*a* may comprise a planar surface and each of three of sides of the ledge member 115*a* may also comprise a planar surface. Therefore, as shown in FIG. 4, the planar surface of each of the three sides (113*b*, 113*c*, 113*c*) of ledge member 113*a* may be engaged with the planar surface of the respective matching side (115*b*, 115*c*, 115*c* respectively) of ledge member 115*a*. Hence, the three sides of the first ledge member 113*a* may be put into flush contact with three sides of the second ledge member 115*a*. Therefore, the junction 121 may include three different planar surfaces of the ledge member 113*a* and three different planar surfaces of the ledge member 115*a*, wherein each of the planar surfaces of the three sides of ledge member 113*a* are abutting and in planar contact with the respective planar surfaces of the three sides of the ledge member 115*a*. Such a configuration, wherein each of the sides of the two ledge members 113*a* and 115*a* engages with a corresponding respective side of the opposite ledge member, provides a connection between the two ledge members 113*a* and 115*a* which effectively transfers force between the respective sections 113 and 115 of the crown 112 of the golf club head body 102.

According to aspects of this disclosure, sections may include projections and/or corresponding recesses for accepting the projections. For example, ledge member 113*a* may include one or more projections which extend upwards out of the horizontal side 113*c* while ledge member 115*a* may include corresponding recesses in the horizontal side 115*c* for receiving the projection(s) of 113*c*. Additionally, or alternatively, either or both of the vertical sides 113*b*, 113*d* may include projections while either or both of the vertical sides 115*b*, 115*d* may include corresponding recesses for receiving such projections.

While the ledges 113*a* and 115*a* are shown as rectangular, this is merely an illustrative embodiment. According to aspects of this disclosure, the ledges 113*a* and 115*a* may be formed in other configurations. For example, the ledges 113*a* and 115*a* could exhibit corresponding curved regions. For example, according to some embodiments, the ledges 113*a* and 115*a* may include curved ridges along with corresponding recesses for receiving the ridges. For example, the ridges of one ledge (e.g., 113*a*) could correspond to the recesses on the other ledge (e.g., 115*a*). Therefore, the ridges and the recesses may provide an interlocking feature between the two sections. For example, instead of a planar surface at the horizontal side 115*c*, the surface could be a convex curved surface and instead of a planar surface at the horizontal side 113*c*, the surface could be a concave curved surface that matches the shape of the convex curved surface of horizontal side 115*c* and thereby may receive that convex curved surface of horizontal side 113*c*.

In an alternative embodiment, the first and second sections may include angled sides. For example, the first section may include a first upper side and a second lower side that are configured in a triangular shape that forms a protrusion which faces (i.e., points towards) the second section. Further, the second section may include a first upper side and a second lower side that are configured in a complementary triangular shape that forms a recess for receiving the protrusion. Other embodiments may include rectangular or other polygonal configurations similar to the one described above wherein the sides of the first section have corresponding and matching sides in the second section with which the first sides engage (e.g., abut) in order for the first and section sections to mate. As long as the sections 113 and 115 are configured so that each of the sides of the first section 113 may be put in contact (e.g., flush contact) with each of the corresponding and matching sides of the second section 115, the configuration is considered within the scope of this disclosure.

According to some aspects of this disclosure, the parts of golf club that comprise the golf club head body (e.g., the top 112) may have more than two sections. For example, the crown 112 may have three or more sections that are engaged with each other to form the crown 112. Such sections could engage with each other in the way described above. For example, according to some aspects of this disclosure an insert section could be placed between two sections of the golf club head.

Aspects of this disclosure relate to a method for producing golf clubs and golf club heads such as the wood type golf club head described above. One method according to an illustrative aspect of this disclosure may include providing at least a first section of a part of a golf club head body, wherein the first section includes a first ledge member which includes two vertical edges and a horizontal edge therebetween configured in the "stair step" arrangement described above. The method may also include providing a second section of the portion of a golf club head body, wherein the second section includes a second ledge member which includes two vertical edges and a horizontal edge therebetween configured in the "inverted stair step" arrangement described above. It is noted that the first section and the second section may be separate and distinct from one another and may be configured to be engaged to form at least a part of the golf club head body. The method may also include engaging the first section with the second section such that the vertical edges of the first ledge member engage with the matching vertical edges of the second ledge member and the horizontal edge of the first ledge member engages with the matching horizontal edge of the second ledge member. The method may also include joining the first section together with the second section at the junction area by adhesives, soldering, brazing, welding, fusing or mechanical connectors. It is noted that the above described part of the golf club head may be, a top (or crown), a sole, etc.

Forming the above described portions of the golf club head with different sections in the above described configuration provides several benefits. First, by forming the portions of the golf club head body 102 with different sections, golf club head manufacturers can easily incorporate multiple types of materials into the structure of the golf club head body 102. For example, different portions could be made from different metals, composite materials, polymer materials, combinations of such materials, etc. Further, as discussed above, each of the different portions can be made by forging, casting, molding, and/or using other techniques and processes, including techniques and processes that are conventional and known in the art. Additionally, the different portions may be individually bonded together to form the golf club head (e.g., by adhesive, tape, brazing, welding, soldering, fusing, mechanical connectors, etc.). Therefore, the performance of the golf club head can be optimized by using different materials at different portions of the club head while the construction of the golf club head remains relatively simple. For example, a first section (or a portion thereof) could be made from a first material or combination of materials. Further, a second section (or a portion thereof) could be made from a second material or combination of materials. The first and second sections may be formed separately from each other and/or the remainder of the golf club head body 102. Forming the sections separately from each other ensures that the sections may be formed without complications that may have arisen due to the different material(s) in the other sections, forming techniques that may be required for forming the other section(s) of the golf club head body, etc. For example, in a first section, a particular ball striking face may be employed. The particular ball striking face which provides a particular coefficient of restitution may require a forming process that would be difficult to perform if that first section of the golf club head body had to be manufactured in conjunction with a second section of the golf club head body. Hence, the above described golf club head body 102 with different sections may provide an efficient way to produce a golf club head body 102 with such a coefficient of restitution. Hence, it is understood that the different sections of the golf club head body and the golf club head body itself may be formed efficiently.

The different materials used in the different section of the golf club head body may have different weighting properties, densities, rigidities, strengths, etc. Therefore, different sections of the golf club head body 102 may be combined to provide a golf club head body 102 with different properties depending on the particular sections that are used to form the golf club head body 102. For example, the center of gravity of the golf club head body 102 may be varied based on the unique combination of different sections (and different materials therein) that are used to form the golf club head body 102. Further, other properties of the golf club head body, such as: the moment of inertia, coefficient of restitution, etc. may be varied in the same manner as desired. For example, a first material may be used for the first section, while a second material with different weighting characteristics may be used for the second section. The different materials in the respective sections may affect the overall properties of the golf club head body (e.g., weight distribution) and, therefore, may be used to manipulate the location of the center of gravity of the club head body (e.g., shift the center of gravity in a particular direction). Additionally, the different materials may be used to manipulate the moment of inertia of the club head body (e.g., move the weight of the golf club head body to a particular position to increase the moment of inertia). Thereby, the club may be optimized for a particular purpose.

Figure 5A:
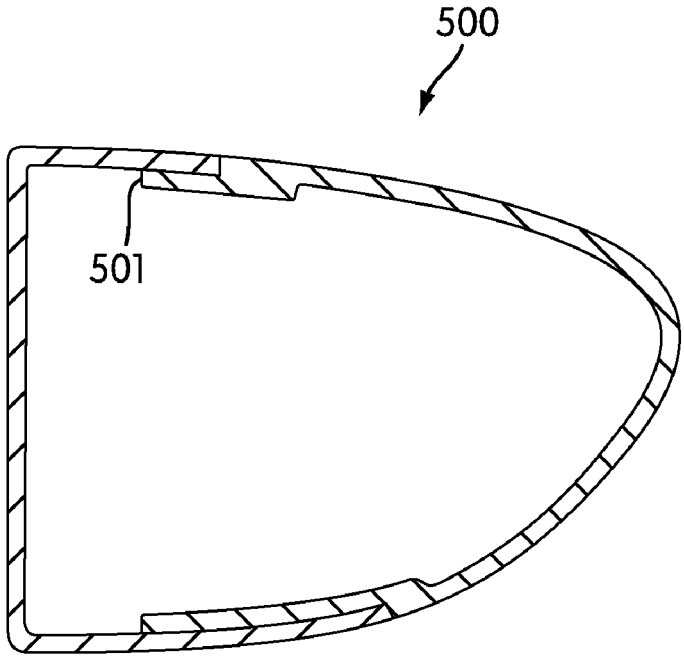
FIGS. 5A and 5B are views of an example golf club head according to at least some aspects of this disclosure.
Figure 5B:
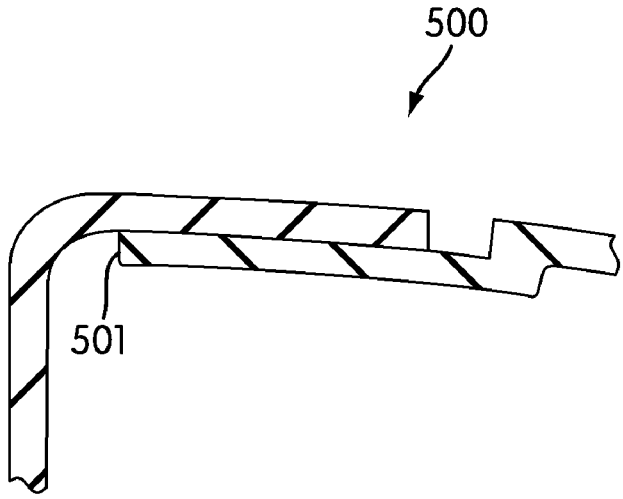

Further, the structure of the junction 121 may provide a stronger joint as compared with a joint wherein not all the sides of the opposing/adjoining sections are connected to each other. In other words, some golf club heads may have different sections which are joined together at a joint. However, in such golf club heads, one or more of the sides of a first opposing section may not have a corresponding/matching side in the second, opposing section with which the side(s) of the first opposing section can engage. FIG. 5 shows an example of such a joint in a golf club head 500 with such a "floating" side 501 in the first opposing section that does not engage with a corresponding/matching side in the second opposing section. In contrast to a joint wherein some sides of a section are floating (i.e., do not engage or connect with a corresponding matching side in the golf club head), a junction according to some aspects of the disclosure creates a single continuous piece with no floating edges (see e.g., FIG. 4). Therefore, as a result of the larger connected area between the two sections, a force (e.g., a force from an impact) can be distributed over the larger connected area (i.e., a junction). This will increase the strength of the golf club head at the junction and its resistance to failure from the impact. Additionally, the structure of the above described junction 121 creates multiple planar surfaces which are ideal for placing adhesives or other connecting means. Hence, additional strength may be imparted to the junction 121 and the golf club head body 102 due to the additional planar surfaces. In other words, the above described structure provides more surface area. Therefore, additional adhesive may be provided over the greater amount of surface area. As a result, a stronger bond may be created due to not only the additional adhesive, but also, the greater amount of contact area on which the adhesive is placed.

While the above configured sections and engagement process has been described with reference to the crown 112, the configured sections and engagement process according to this disclosure could be applied to any part of the golf club head. For example, any desired part of the golf club head body (e.g., the ball striking face portion 108, the sole 114, etc.) could be configured in separate distinct sections wherein one body part may include a ledge member formed to engage with a corresponding/matching ledge member of another body part.

Figure 6:
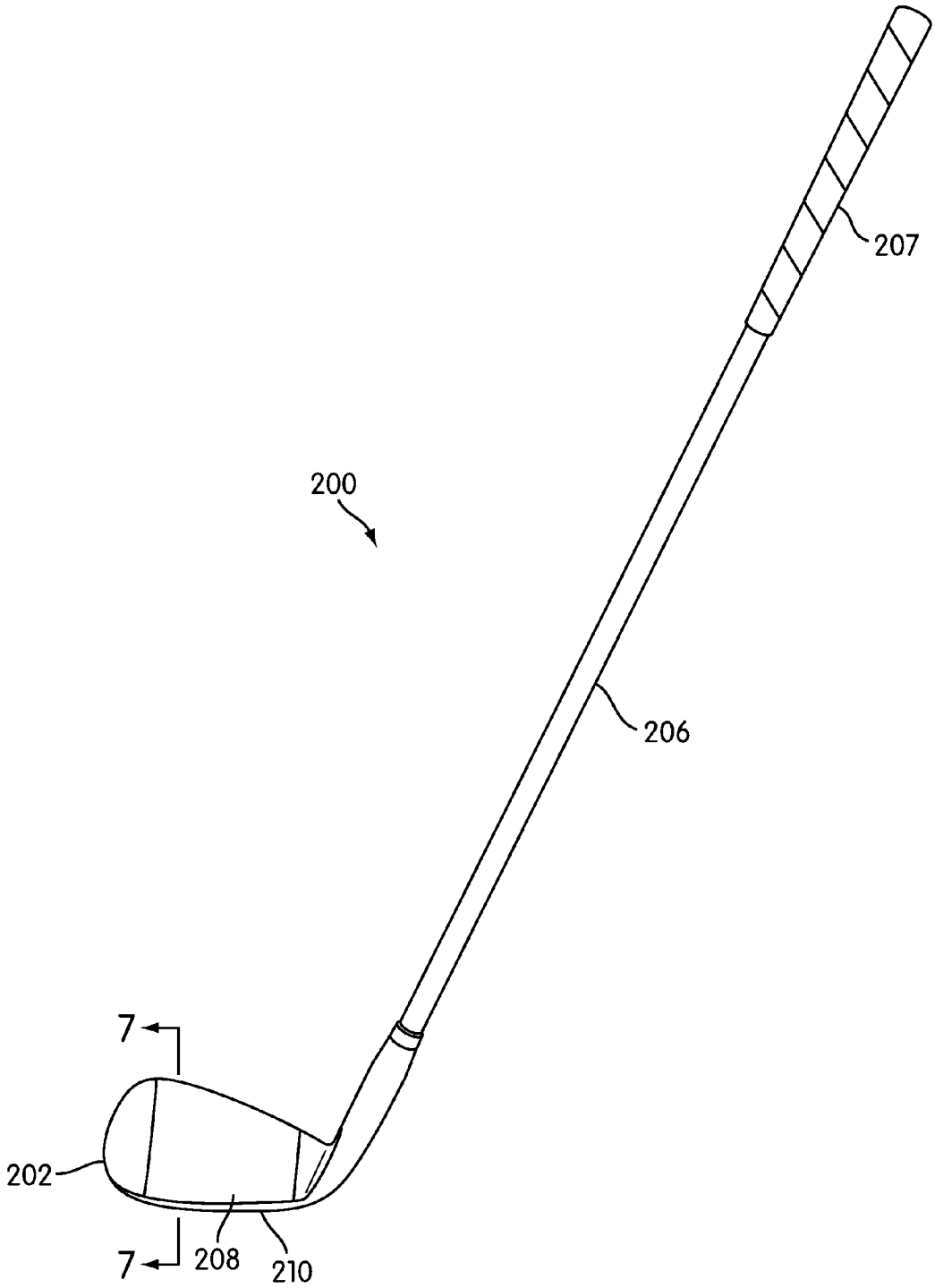
FIG. 6 is an illustrative embodiment of a golf club with an iron type golf club head according to at least some aspects of this disclosure.

An illustrative embodiment according to one or more aspects of the disclosure is shown in FIG. 6. FIG. 6 shows a golf club 200 at the address position which includes an iron-type golf club head 202 in accordance with aspects of this disclosure and a shaft 206 and grip 207 engaged with the iron-type golf club head 202. As seen in FIG. 6, the club head body 202 of this illustrated example includes a ball striking face portion 208, and a rear portion 210.

Figure 7:
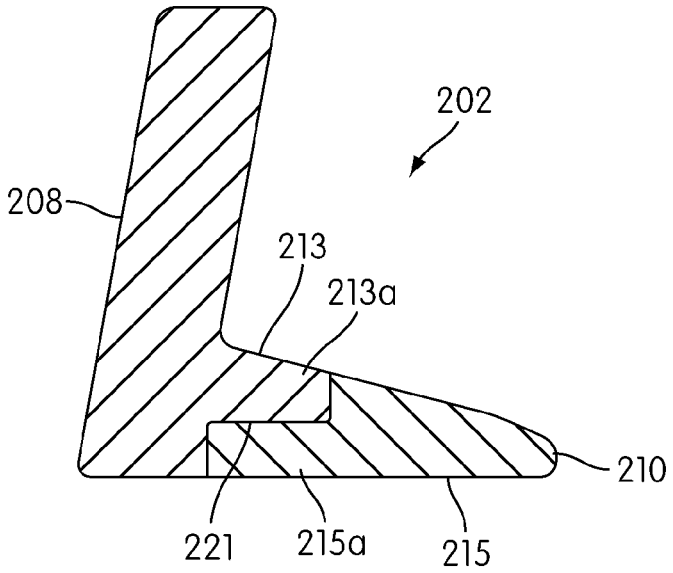
FIG. 7 is a cross sectional view of the iron-type golf club head structure shown in FIG. 6.
Figure 8:
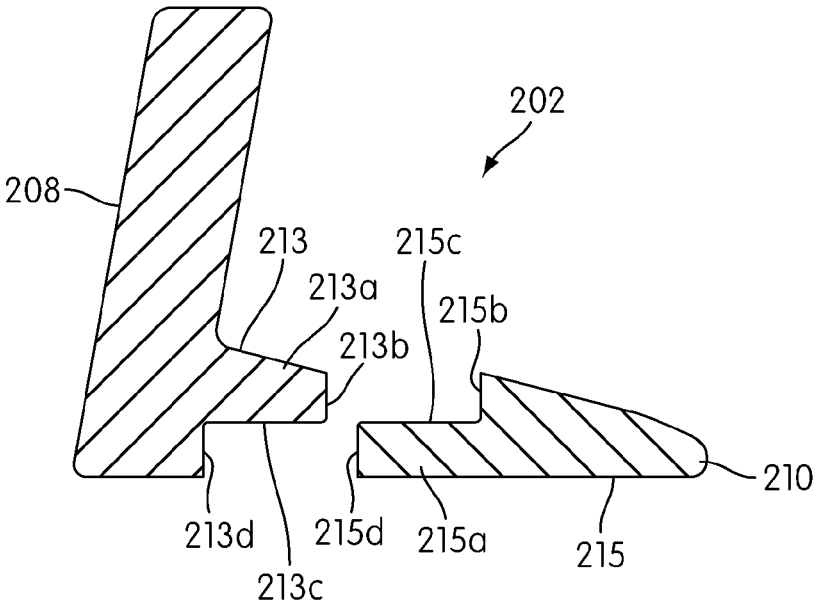
FIG. 8 is an exploded view of the cross-sectional view shown in FIG. 7.

FIG. 7 is a cross-sectional view of the illustrative golf club head 202 shown in FIG. 6. As shown in this FIG. 7, the rear portion 210 may extend rearward from the ball striking face portion 208. Further, as seen in FIG. 7, the ground contacting surface of the club head body when the club is in the address position (e.g., as shown in FIG. 6) may be comprised of both the ball striking face portion 208, and the rear portion 210. As discussed above, if desired, the club head body 202 may be made from multiple pieces that are connected together (e.g., by adhesives or cements; by welding, soldering, brazing, or other fusing techniques; by mechanical connectors; etc.). For example, according to aspects of this disclosure, and as shown in FIG. 7, the ball striking face portion 208 and the rear portion 210 may be separate and distinct portions that are engaged in order to create the golf club head body 202. FIG. 8 shows an exploded view of the above golf club head body 202 wherein the ball striking face portion 208 and the rear portion 210 are separated from each other.

As seen in FIGS. 7 and 8, the ball striking face portion 208 may include a ball striking face and a first section 213. Further, the rear portion 210 may include a second section 215. The first section 213 and second section 215 may be configured to engage with each other. For example, according to aspects of the disclosure, the first section 213 may include sides that are configured to engage with sides of second section 215. Further, according to aspects of the disclosure, the first section 213 and the second section 215 may include matching sides. In other words, the sides of the first section 213 may match with corresponding sides of the second section 215 so the first section 213 mates with the second section 215.

For example, as illustrated in FIG. 8, the first section 213 may include a ledge member 213*a* configured to engage a mating ledge member 215*a* of second section 215. As seen in FIG. 8, ledge member 213*a* may be configured to include two vertical sides 213*b*, 213*d* and a horizontal side 213*c* therebetween. Further, mating ledge member 215*a* may also be configured to include two vertical sides 215*b*, 215*d* and a horizontal side 215*c* therebetween. As seen, the ledge member 213*a* may have a configuration wherein when the club head body 102 is at the address position, a first vertical side 213*b* is at a greater height than the second vertical side 213*d*. Further, the horizontal side 213*c* of the ledge member 213*a* may extend horizontally between the lower edge of the first vertical side 213*b* and the upper edge of the second vertical side 213*d*. Additionally, in such an embodiment, when the club head body 202 is at the address position, the surface of the horizontal side 213*c* may face upward. Hence, in such an embodiment, when the club head body 202 is at the address position, the three sides 213*b*, 213*c* and 213*d* of ledge member 213*a* are configured in an "inverted stair step" arrangement. The sides of the ledge member 215*a* may be configured in similar arrangement that mates with the sides of the first ledge member 213*a*. For example, as seen, the sides of the second ledge member 215*a* may be configured wherein when the club head body 202 is at the address position, a first vertical side 215*b* is at a greater height than the second vertical side 215*d*. Further, the horizontal side 215*c* of the ledge member 215*a* may extend horizontally between the lower edge of the first vertical side 215*b* and the upper edge of the second vertical side 215*d*. Additionally, in such an embodiment, when the club head body 202 is at the address position, the surface of the horizontal side 215*c* may face upward. Hence, in such an embodiment, when the club head body 202 is at the address position, the three sides 215*b*, 215*c* and 215*d* of ledge member 215*a* are configured in a "stair step" arrangement.

Therefore, the arrangement of the sides (213*b*, 213*c*, 213*d*) of ledge member 213*a* (i.e., the inverted "stair step" configuration) and the arrangement of the sides (215*b*, 215*c*, 215*d*) of ledge member 215*a* (i.e., the "stair step" configuration) are complementary. In other words, each of the sides (213*b*, 213*c*, 213*d*) of the first section 213 may match with corresponding sides (215*b*, 215*c*, 215*d* respectively) of the second section 215 so the first section 213 mates with the second section 215.

Therefore, when the ledges 213*a* and 215*a* are engaged, the first vertical side 213*b* of ledge member 213*a* matches and engages with the first vertical side 215*b* of ledge member 215*a*, the second vertical side 213*d* of ledge member 213*a* matches and engages with the second vertical side 215*d* of ledge member 215*a*, and the horizontal side 213*c* of ledge member 213*a* matches and engages with the horizontal side 215*c* of ledge member 215*a*. For example, as shown in FIG. 4, the sides of the first ledge member 213*a* may abut their respective matching sides of the second ledge member 215*a*. In this way, the sections 213 and 215 are mated with each other.

According to aspects of this disclosure, the matching sides of the ledge members may have substantially the same shape and dimensions. For example, in the depicted embodiment, the shape and dimensions of the first vertical side 213*b* of ledge member 213*a* may be substantially the same as the shape and dimensions of the matching first vertical side 215*b* of ledge member 215*a*. Similarly, the second vertical side 213*d* may have substantially the same shape and dimensions as the matching second vertical side 215*d* and the horizontal side 213*c* may have substantially the same shape and dimensions as the matching horizontal side 215*c*.

According to aspects of this disclosure the sides of the ledges 213 and 215 may be planar. For example, as shown in the depicted embodiment, each of three of sides of the ledge member 213*a* may comprise a planar surface and each of three of sides of the ledge member 215*a* may also comprise a planar surface. Therefore, as shown in FIG. 8, the planar surface of each of the three sides (213*b*, 213*c*, 213*d*) of ledge member 213*a* may be engaged with the planar surface of the respective matching side (215*b*, 215*c*, 215*d* respectively) of ledge member 215*a*. Hence, the three sides of the first ledge member 213*a* may be put into flush contact with three sides of the second ledge member 215*a*. Therefore, the junction 221 may include three different planar surfaces of the ledge member 113*a* and three different planar surfaces of the ledge member 215*a*, wherein each of the planar surfaces of the three sides of ledge member 213*a* are abutting and in planar contact with the respective planar surfaces of the three sides of the ledge member 215*a*. Such a configuration, wherein each of the sides of the two ledge members 213*a* and 215*a* engages with a corresponding respective side of the opposite ledge member, provides a connection between the two ledge members 213*a* and 215*a* which effectively transfers force between the respective sections 213 and 215 of the golf club head body 202.

According to aspects of this disclosure, sections may include projections and/or corresponding recesses for accepting the projections. For example, ledge member 213*a* may include one or more projections which extend upwards out of the horizontal side 213*c* while ledge member 215 may include corresponding recesses in the horizontal side 215*c* for receiving the projection(s) of 213*c*. Additionally, or alternatively, either or both of the vertical sides 213*b*, 213*d* may include projections while either or both of the vertical sides 215*b*, 215*d* may include corresponding recesses for receiving such projections.

While the ledges 213*a* and 215*a* are shown as rectangular, this is merely an illustrative embodiment. According to aspects of this disclosure, the ledges 213*a* and 215*a* may be formed in other configurations. For example, the ledges 213*a* and 215*a* could exhibit corresponding curved regions. For example, according to some embodiments, the ledges 213*a* and 215*a* may include curved ridges along with corresponding recesses for receiving the ridges. For example, the ridges of one ledge (e.g., 213*a*) could correspond to the recesses on the other ledge (e.g., 215*a*). Therefore, the ridges and the recesses may provide an interlocking feature between the two sections. For example, instead of a planar surface at the horizontal side 215*c*, the surface could be a convex curved surface and instead of a planar surface at the horizontal side 213*c*, the surface could be a concave curved surface that matches the shape of the convex curved surface of horizontal side 115*c* and thereby may receive that convex curved surface of horizontal side 113*c*.

In an alternative embodiment, the first and second sections may include angled sides. For example, the first section may include a first upper side and a second lower side that are configured in a triangular shape that forms a protrusion which faces (i.e., points towards) the second section. Further, the second section may include a first upper side and a second lower side that are configured in a complementary triangular shape that forms a recess for receiving the protrusion. Other embodiments may include rectangular or other polygonal configurations similar to the one described above wherein the sides of the first section have corresponding and matching sides in the second section with which the first sides engage (e.g., abut) in order for the first and section sections to mate. As long as the sections 213 and 215 are configured so that each of the sides of the first section 213 may be put in contact (e.g., flush contact) with each of the corresponding and matching sides of the second section 215, the configuration is considered within the scope of this disclosure.

According to some aspects of this disclosure, the golf club head body 202 may have more than two sections. For example, the golf club head body may have three or more sections that are engaged with each other in the way described above. For example, according to some aspects of this disclosure an insert could be placed between two sections of the golf club head body.

Aspects of this disclosure relate to a method for producing golf clubs and golf club heads such as the iron type golf club head described above. One method according to an illustrative aspect of this disclosure may include providing at least a first section of a part of a golf club head body, wherein the first section includes a first ledge member which includes two vertical edges and a horizontal edge therebetween configured in the inverted "stair step" arrangement described above. The method may also include providing a second section of a part of a golf club head body, wherein the second section includes a second ledge member which includes two vertical edges and a horizontal edge therebetween configured in the "stair step" arrangement described above. It is noted that the first section and the second section may be separate and distinct from one another and may be configured to be engaged to form at least a part of the golf club head body. The method may also include engaging the first section with the second section such that the vertical edges of the first ledge member engage with the matching vertical edges of the second ledge member and the horizontal edge of the first ledge member engages with the matching horizontal edge of the second ledge member. The method may also include joining the first section together with the second section at the junction area by adhesives, soldering, brazing, welding, fusing or mechanical connectors.

Forming the above described portions of the golf club head with different sections in the above described configuration provides several benefits. First, by forming the portions of the golf club head body 102 with different sections, golf club head manufacturers can easily incorporate multiple types of materials into the structure of the golf club head body 102. For example, different portions could be made from different metals, composite materials, polymer materials, combinations of such materials, etc. Further, as discussed above, each of the different portions can be made by forging, casting, molding, and/or using other techniques and processes, including techniques and processes that are conventional and known in the art. Additionally, the different portions (e.g., the ball striking face portion or the rear portion) may be individually bonded together to form the golf club head. Therefore, the performance of the golf club head can be optimized by using different material at different portions of the club head while the construction of the golf club head remains relatively simple. For example, two different sections made from different and dissimilar materials may be brazed together in order to provide and optimized golf club head body 202. For example, a first section (or a portion thereof) could be made from a first material or combination of materials while a second section (or a portion thereof) could be made from a second material or combination of materials. These first and second sections may be formed separately from each other and/or the remainder of the golf club head body 202. As stated above, the sections may be formed by forging, casting, molding, and/or using other techniques and processes. The first and the second sections of the golf club head body 202 may then be brazed together to form the golf club head body 202. Of course, other methods of joining the sections may be used. It is noted the materials from which the sections are made may be taken into account in determining the technique by which to join the sections.

The different materials used in the different section of the golf club head body may have different weighting properties, densities, rigidities, strengths, etc. Therefore, different sections of the golf club head body 202 may be combined to provide a golf club head body 202 with different properties depending on the particular sections that are used to form the golf club head body 202. For example, the center of gravity of the golf club head body 202 may be varied based on the unique combination of different sections (and different materials therein) that are used to form the golf club head body 202. Further, other properties of the golf club head body, such as: the moment of inertia, coefficient of restitution, etc. may be varied in the same manner as desired. For example, a first material may be used for the first section, while a second material with different weighting characteristics may be used for the second section. The different materials in the respective sections may affect the overall properties of the golf club head body (e.g., weight distribution) and, therefore, may be used to manipulate the location of the center of gravity of the club head body (e.g., shift the center of gravity in a particular direction). Additionally, the different materials may be used to manipulate the moment of inertia of the club head body (e.g., move the weight of the golf club head body to a particular position to increase the moment of inertia). Thereby it is possible to customize the club head body and create unique combinations of materials in the club head body. Hence, the club head body may be optimized for a particular purpose. For example, this configuration of forming a golf club head body with different portions allows the manufacturers to easily combine differently configured ball striking face portions (e.g., different face plates, different angled lofts, etc.) with differently configured rear portions (e.g., different bounce angles, different thicknesses, etc.). Hence the manufacturer can easily create different club head bodies for designed for different purposes.

While the above configured sections and engagement process has been described with reference to the ball striking face portion 208 and the rear portion 210, the configured portions and engagement process according to this disclosure could be applied to other portions of the golf club head. For example, the golf club head body could be comprised of any separate part wherein one body part may include a ledge member formed to engage with a ledge member of another body part.

III. Conclusion

Aspects of the present invention are described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims.

For example, the dimensions and/or other characteristics of a golf club head structure according to examples of this invention may vary significantly without departing from the disclosure. For example, the above described aspects of the disclosure may be applied to any wood type club head including, wood type hybrid clubs, fairway woods, drivers, etc. Similarly, the above described aspects of the disclosure may be applied to any iron type club head including, for example: iron type hybrid clubs, driving irons, 0 through 10 irons, wedges (e.g., pitching wedges, lob wedges, gap wedges, sand wedges, etc.), chipping clubs, putters, etc.

Additionally, the various features and concepts described above in conjunction with FIGS. 1 through 8 may be used individually and/or in any combination or subcombination without departing from this disclosure.

I claim:

1. A golf club head comprising:

a wood type golf club head body including a ball striking face portion, a top and a sole;

wherein at least one of the ball striking face portion, the top and the sole of the golf club head body constitutes a first portion that includes a first section and a second section that are separate and distinct from one another and are engaged to form at least a part of the first portion, wherein the first section includes a first ledge member, the second section includes a second ledge member and the first ledge member and the second ledge member are engaged to form a junction area, wherein the first ledge member includes a first vertical side, a second vertical side, a third vertical side, a first horizontal side between the first vertical side and the second vertical side, and a second horizontal side between the second vertical side and the third vertical side, wherein the first vertical side of the first ledge member extends inward from an outer surface of the first section to the first horizontal side of the first ledge member such that the first horizontal side of the first ledge member is recessed from the outer surface of the first section, and wherein the third vertical side of the first ledge member extends inwardly from an inner surface of the first section to the second horizontal side of the first ledge member such that the second horizontal side of the first ledge member projects inwardly from the inner surface of the first section into an interior of the golf club head body, and the second ledge member includes a first vertical side and a second vertical side and a horizontal side therebetween, wherein the first and second ledge members are complementary wherein when the first and second ledge members are engaged, the first vertical side of the first ledge member matches and engages with the first vertical side of the second ledge member, the second vertical side of the first ledge member matches and engages with the second vertical side of the second ledge member, and the first horizontal side of the first ledge member matches and engages with the horizontal side of the second ledge member.

2. The golf club head according to claim 1, the first ledge member is configured such that when the club head body is at the address position, the first vertical side of the first ledge member is at a greater height than the second vertical side of the first ledge member and first horizontal side of the first ledge member extends between a lower edge of the first vertical side of the first ledge member and an upper edge of the second vertical side of the first ledge member, wherein a surface of the first horizontal side of the first ledge member faces upward and the second horizontal side of the first ledge member extends between a lower edge of the third vertical side of the first ledge member and a lower edge of the second vertical side of the first ledge member; and the second ledge member is configured such that when the club head body is at the address position, the first vertical side of the second ledge member is at a greater height than the second vertical side of the second ledge member and the horizontal side of the second ledge member extends between a lower edge of the first vertical side of the second ledge member and an upper edge of the second vertical side of the second ledge member, wherein a surface of the horizontal side of the second ledge member faces downward.

3. The golf club head according to claim 2, wherein each of the first vertical side, the second vertical side and the first horizontal side of the first ledge member is in flush contact with a matching side of the second ledge member.

4. The golf club head according to claim 3, wherein the shape and dimensions of the first vertical side of the first ledge member are substantially the same as the shape and dimensions of the first vertical side of the second ledge member, wherein the shape and dimensions of the second vertical side of the first ledge member are substantially the same shape and dimensions as second vertical side of the second ledge member, wherein the shape and dimensions of the first horizontal side of the first ledge member are the substantially the same as the shape and dimensions of the horizontal side of the second ledge member.

5. The golf club head according to claim 1, wherein the junction area includes three different planar surfaces of the first ledge member and three different planar surfaces of the second ledge member, and wherein each of the three planar surfaces of the first ledge member are abutting and in planar contact with the three respective planar surfaces of the second ledge member.

6. The golf club head according to claim 1, wherein the first and second sections are joined together at the junction area by adhesives, soldering, brazing, welding, fusing or mechanical connectors.

7. The golf club head according to claim 1, wherein a second portion of the golf club head body includes a third section and a fourth section that are separate and distinct from one another and are engaged to form at least a part of the second portion, wherein the third section includes a third ledge member, the fourth section includes a fourth ledge member and the third ledge member and the fourth ledge member are engaged to form a second junction area, wherein the third ledge member includes a first vertical side and a second vertical side and a horizontal side therebetween and the fourth ledge member includes a first vertical side and a second vertical side and a horizontal side therebetween, wherein the third and fourth ledge members are complementary such that when the third and fourth ledge members are engaged the first vertical side of the third ledge member matches and engages with the first vertical side of fourth ledge member, the second vertical side of the third ledge member matches and engages with the second vertical side of the fourth ledge member, and the horizontal side of the third ledge member matches and engages with the horizontal side of the fourth ledge member.

8. The golf club head according to claim 7, wherein the third ledge member is configured such that when the club head body is at the address position, the first vertical side of the third ledge member is at a greater height than the second vertical side of the third ledge member and the horizontal side of the third ledge member extends between a lower edge of the first vertical side of the third ledge member and an upper edge of the second vertical side of the third ledge member, wherein the surface of the horizontal side of the third ledge member faces upward;

the fourth ledge member is configured such that when the club head body is at the address position, the first vertical side of the fourth ledge member is at a greater height than the second vertical side of the fourth ledge member and the horizontal side of the fourth ledge member extends between a lower edge of the first vertical side of the fourth ledge member and an upper edge of the second vertical side of the fourth ledge member, wherein the surface of the horizontal side of the fourth ledge member faces downward.

9. The golf club head according to claim 8, wherein each of the first vertical side, the second vertical side and the horizontal side of the third ledge member is in flush contact with a matching side of the fourth ledge member.

10. The golf club head according to claim 9, wherein the shape and dimensions of the first vertical side of the third ledge member are substantially the same as the shape and dimensions of the first vertical side of the fourth ledge member, wherein the shape and dimensions of the second vertical side of the third ledge member are substantially the same shape and dimensions as the second vertical side of the fourth ledge member, wherein the shape and dimensions of the horizontal side of the third ledge member are substantially the same as the shape and dimensions of the horizontal side of the fourth ledge member.

11. The golf club head according to claim 10, wherein the first portion is the top and the second portion is the sole.

12. The golf club head according to claim 7, wherein the junction area includes three different planar surfaces of the third ledge member and three different planar surfaces of the fourth ledge member, and wherein each of the three planar surfaces of the third ledge member are abutting and in planar contact with the three respective planar surfaces of the fourth ledge member.

13. The golf club head according to claim 7, wherein the first and second sections are joined together at the junction area by adhesives, soldering, brazing, welding, fusing or mechanical connectors.

14. A golf club head comprising:

a wood type golf club head body including a top and a sole;

wherein the top of the golf club head body includes a first section and a second section that are separate and distinct from one another and are engaged to form at least a part of the top, wherein the first section includes a first ledge member, the second section includes a second ledge member and the first ledge member is engaged with the second ledge member to form a first junction area, wherein the first ledge member includes a first vertical side, a second vertical side, a third vertical side, a first horizontal side between the first vertical side and the second vertical side, and a second horizontal side between the second vertical side and the third vertical side, wherein the first vertical side of the first ledge member extends inward from an outer surface of the first section to the first horizontal side of the first ledge member such that the first horizontal side of the first ledge member is recessed from the outer surface, and wherein the third vertical side of the first ledge member extends inwardly from an inner surface of the first section to the second horizontal side of the first ledge member such that the second horizontal side of the first ledge member projects inwardly from the inner surface into an interior of the golf club head body, and the second ledge member includes a first vertical side and a second vertical side and a horizontal side therebetween wherein the first and second ledge members are complementary wherein when the first and second ledge members are engaged the first vertical side of the first ledge member matches and engages with the first vertical side of the second ledge member, the second vertical side of the first ledge member matches and engages with the second vertical side of the second ledge member, and the horizontal side of the first ledge member matches and engages with the horizontal side of the second ledge member, wherein the sole of the golf club head body includes a third section and a fourth section that are separate and distinct from one another and are engaged to form at least a part of the sole, wherein the third section includes a third ledge member, the fourth section includes a fourth ledge member and the third ledge member is engaged with the fourth ledge member to form a second junction area, wherein the third ledge member includes a first vertical side, a second vertical side, a third vertical side, a first horizontal side between the first vertical side and the second vertical side, and a second horizontal side between the second vertical side and the third vertical side, wherein the first vertical side of the third ledge member extends inward from an outer surface of the third section to the first horizontal side of the third ledge member such that the first horizontal side of the third ledge member is recessed from the outer surface of the third section, and wherein the third vertical side of the third ledge member extends inwardly from an inner surface of the third section to the second horizontal side of the third ledge member such that the second horizontal side of the third ledge member projects inwardly from the inner surface of the third section into an interior of the golf club head body, and the fourth ledge member includes a first vertical side and a second vertical side and a horizontal side therebetween wherein the third and fourth ledge members are complementary wherein when the third and fourth ledge members are engaged the first vertical side of the third ledge member matches and engages with the first vertical side of fourth ledge member, the second vertical side of the third ledge member matches and engages with the second vertical side of the fourth ledge member, and the horizontal side of the third ledge member matches and engages with the horizontal side of the fourth ledge member.

15. A golf club head comprising:

an iron type golf club head body including a ball striking face portion and a rear portion;

wherein the ball striking face portion and the rear portion are separate and distinct from one another and are engaged to form at least a part of the iron type golf club head body, wherein the ball striking face portion includes a first ledge member, the rear portion includes a second ledge member and a top surface and the first ledge member and the second ledge member are engaged to form a junction area, wherein the first ledge member includes a top surface, a first vertical side, extending downward from the top surface of the first ledge member, a second vertical side, and a horizontal side between the first and second vertical sides of the first ledge member, and the second ledge member includes a first vertical side extending downward from the top surface of the rear portion, a second vertical side, and a horizontal side between the first and second vertical sides of the second ledge member, wherein the first and second ledge members are complementary so that when the first and second ledge members are engaged the first vertical side of the first ledge member matches and engages with the first vertical side of second ledge member, the second vertical side of the first ledge member matches and engages with the second vertical side of the second ledge member, the horizontal side of the first ledge member matches and engages with the horizontal side of the second ledge member, and the top surface of the first ledge member is flush with the top surface of the rear portion.

16. The golf club head according to claim 15, wherein the first ledge member is configured such that when the club head body is at the address position, the first vertical side of the first ledge member is at a greater height than the second vertical side of the first ledge member and the horizontal side of the first ledge member extends between a lower edge of the first vertical side of the first ledge member and an upper edge of the second vertical side of the first ledge member, wherein the surface of the horizontal side of the first ledge member faces downward;

the second ledge member is configured such that when the club head body is at the address position, the first vertical side of the second ledge member is at a greater height than the second vertical side of the second ledge member and the horizontal side of the second ledge member extends between a lower edge of the first vertical side of the second ledge member and an upper edge of the second vertical side of the second ledge member, wherein the surface of the horizontal side of the second ledge member faces upward.

17. The golf club head according to claim 16, wherein each of the first vertical side, the second vertical side and the horizontal side of the first ledge member is in flush contact with a matching side of the second ledge member.

18. The golf club head according to claim 17, wherein the shape and dimensions of the first vertical side of the first ledge member are substantially the same as the shape and dimensions of the first vertical side of the second ledge member, wherein the shape and dimensions of the second vertical side of the first ledge member are substantially the same shape and dimensions as the second vertical side of the second ledge member, wherein the shape and dimensions of the horizontal side of the first ledge member are the substantially the same as the shape and dimensions of the horizontal side of the second ledge member.

19. The golf club head according to claim 15, wherein the junction area includes three different planar surfaces of the first ledge member and three different planar surfaces of the second ledge member, and wherein each of the three planar surfaces of the first ledge member are abutting and in planar contact with the three respective planar surfaces of the second ledge member.

20. The golf club head according to claim 15, wherein the first and second sections are joined together at the junction area by adhesives, soldering, brazing, welding, fusing or mechanical connectors.

* * * * *